US008286542B2

(12) United States Patent
Griffin

(10) Patent No.: US 8,286,542 B2
(45) Date of Patent: Oct. 16, 2012

(54) GAS PISTON RETROFIT FOR RIFLE

(75) Inventor: Ritchie Griffin, Bradenton, FL (US)

(73) Assignee: Osprey Defense LLC, Satasota, FL (US)

( * ) Notice: Subject to any disclaimer, the term of this patent is extended or adjusted under 35 U.S.C. 154(b) by 0 days.

(21) Appl. No.: 13/277,113

(22) Filed: Oct. 19, 2011

(65) Prior Publication Data

US 2012/0180645 A1 Jul. 19, 2012

Related U.S. Application Data

(63) Continuation of application No. 12/352,484, filed on Jan. 12, 2009, now abandoned.

(60) Provisional application No. 61/020,700, filed on Jan. 11, 2008.

(51) Int. Cl.
*F41A 5/18* (2006.01)

(52) U.S. Cl. ..... 89/191.01

(58) Field of Classification Search ..... 89/191.01, 89/191.02, 192, 193
See application file for complete search history.

(56) References Cited

U.S. PATENT DOCUMENTS

| | | | | |
|---|---|---|---|---|
| 2,386,205 | A * | 10/1945 | Garand | 89/142 |
| 2,393,627 | A * | 1/1946 | Garand | 89/193 |
| 2,715,858 | A * | 8/1955 | Hoppert | 89/193 |
| 3,285,133 | A | 11/1966 | Fowler | |
| 3,329,064 | A * | 7/1967 | Segrest | 89/128 |
| 3,988,964 | A | 11/1976 | Moore | |
| 4,088,057 | A * | 5/1978 | Nasypany | 89/1.701 |
| 4,475,438 | A | 10/1984 | Sullivan | |
| 4,619,184 | A | 10/1986 | Shalev | |
| 4,765,224 | A | 8/1988 | Morris | |
| 5,351,598 | A | 10/1994 | Schuetz | |
| 5,448,940 | A | 9/1995 | Schuetz et al. | |
| 5,570,676 | A | 11/1996 | Gore | |
| 6,112,636 | A | 9/2000 | Besselink | |
| 6,606,934 | B1 | 8/2003 | Rock et al. | |
| 6,722,255 | B2 | 4/2004 | Herring | |
| 6,971,202 | B2 | 12/2005 | Bender | |
| 7,469,624 | B1 | 12/2008 | Adams | |
| 2002/0178901 | A1 | 12/2002 | Bergstrom | |
| 2006/0065112 | A1 | 3/2006 | Kuczynko et al. | |
| 2009/0120277 | A1 | 5/2009 | Adams | |

OTHER PUBLICATIONS

GSR-35™ Black Lightning, date unknown, Ares Defense Systems, Inc., Blacksburg, VA.
Operator's Manual for Shrike 5.56—Advanced Weapons System™, 2005, ver. 1.1, Ares Defense Systems, Inc., Blacksburg, VA.

* cited by examiner

*Primary Examiner* — Bret Hayes
(74) *Attorney, Agent, or Firm* — Morgan, Lewis & Bockius LLP; Victor E. Johnson

(57) ABSTRACT

A gas piston retrofit assembly is provided for a firearm having a bolt assembly mounted within a receiver, a barrel extending forward from the receiver, and a front sight block mounted on the barrel. The retrofit assembly includes a gas tube extending into the front sight block fluidly connected with the barrel, a piston cylinder having an arcuate-shaped piston chamber fluidly connected to the gas tube, a piston including an arcuate-shaped piston head extending forward from a piston body and telescopically received in the piston chamber, and including a piston rod extending rearward from the piston body and dimensioned and configured to extend into the receiver for engaging with a bolt assembly within the receiver. Upon firing a round of ammunition, pressurized gas within the barrel enters the piston chamber to move the piston rearward, for cycling the bolt assembly. A method of using the same is also disclosed.

19 Claims, 16 Drawing Sheets

GAS PISTON RETROFIT FOR RIFLE

CROSS-REFERENCE TO RELATED APPLICATIONS

This application is a Continuation of U.S. patent application Ser. No. 12/352,484 filed on Jan. 12, 2009 and entitled GAS PISTON RETROFIT FOR RIFLE, the entire contents of which is incorporated herein by this reference.

BACKGROUND OF THE INVENTION

1. Field of the Invention

This invention relates, in general, to a gas piston retrofit for a firearm and more particularly to a gas piston retrofit for automatic configured for installation on direct gas impingement automatic and/or semi-automatic firearms, as well as to methods for their installation and use.

2. Description of Related Art

Conventional automatic and semi-automatic firearms, such as the AR-15, typically use a direct gas impingement system to cycle the action of the bolt. Exemplars of such firearms relying on direct gas impingement include U.S. Pat. No. 4,765,224 to Morris, which discloses an automatic rifle gas system, and U.S. Pat. No. 6,971,202 to Bender, which discloses a gas-operated action for auto-loading firearms.

In such gas systems, when the rifle or firearm is fired, gas from the front of the barrel travels through a tube and into the bolt carrier key, the pressure of which gas drives the bolt carrier rearward, rotates and unlocks the bolt, allows the bolt to move back to eject a round and then move forward to feed another round. One problem with such gas impingement system is that un-burnt powder residue, products of combustion, and particulates are carried along with the gas. An accumulation of deposits fouls the action of the rifle or firearm and creates cycle problems resulting in loss of reliability.

Alternative gas piston systems have been devised and utilized in such firearms. Exemplars of such gas piston systems include U.S. Pat. No. 4,475,438 to Sullivan, which discloses gas operated, automatic or semi-automatic firearms, U.S. Pat. No. 5,351,598 to Schuetz, which discloses a gas-operated system, and U.S. Pat. No. 6,722,255 to Herring, which discloses an apparatus and method for actuating a bolt carrier group of a receiver assembly. While such systems may or may not alleviate accumulation of deposits, such systems require extensive modification for firearm retrofit. For example, the Sullivan firearms, the Schuetz system, and the Herring apparatus require radically redesigned receivers and front sights. Furthermore, the modifications required are generally incompatible with standard MIL-SPEC hand guards, and other accessories of the AR15/M16/M4 family of firearms, including, but not limited to rifles, machine guns and carbines.

While there are other designs on the market, such as those provided by Bushmaster Firearms International, Patriot Ordnance Factory, Inc., and Ares Defense Systems, Inc., such designs generally require a substantial investment (e.g., approximately US $1,000 or more) as such designs require redesigned receiver assemblies and/or other major components.

In light of the foregoing, it would be beneficial to have a gas piston retrofit assembly which overcomes the above and other disadvantages of known semi-automatic firearms. Moreover, it would be beneficial to have a relatively low-cost kit that is compatible with conventional direct gas impingement automatic and semi-automatic firearms

BRIEF SUMMARY OF THE INVENTION

One aspect of the present invention is directed to a gas piston retrofit assembly for a firearm having a bolt assembly mounted within a receiver, a barrel extending forward from the receiver, and a front sight block mounted on the barrel. The retrofit assembly may include a gas tube extending into the front sight block fluidly connected with the barrel, a piston cylinder having an arcuate-shaped piston chamber fluidly connected to the gas tube, a piston including an arcuate-shaped piston head extending forward from a piston body and telescopically received in the piston chamber, and including a piston rod extending rearward from the piston body and dimensioned and configured to extend into the receiver for engaging with a bolt assembly within the receiver, a stop ring dimensioned and configured for mounting on the barrel or push rod and for limiting rearward motion of the piston body and easily removable for cleaning, and a bushing through which the piston rod extends. Upon firing a round of ammunition, pressurized gas within the barrel enters the piston chamber to move the piston rearward, for cycling the bolt assembly.

The gas tube and piston cylinder may be monolithically formed. The piston cylinder may include an adjustable valve. The adjustable valve may include a valve pin extending transversely through the piston cylinder. The valve pin may be adjustable to throttle a gas line extending between the gas tube and the piston chamber. The piston body may include a rearward surface dimensioned and configured to abut against the stop ring to limit rearward motion of the piston rod into the receiver. The stop ring may have a gap which can be turned upward to align the gap with the piston body, or may be completely removable thereby preventing abutting contact between the piston body and the stop ring to allow for disassembly of the retrofit assembly.

Another aspect of the present invention is directed to a method of retrofitting a firearm having a bolt assembly mounted within a receiver, a barrel extending forward from the receiver, and a front sight block mounted on the barrel. The method includes one or more of the following steps: connecting a gas tube/chamber with the front sight block for fluid connected with the barrel; providing a piston cylinder having an arcuate-shaped piston chamber fluidly connected to the gas tube; inserting an arcuate-shaped piston head of a piston into the piston chamber, the piston including a piston body and piston rod extending rearward from the piston head, the piston rod dimensioned and configured to extend into the receiver for engaging with a bolt assembly within the receiver; mounting a stop ring on the barrel or push rod, the stop ring being dimensioned and configured for limiting rearward motion of the piston body; and wherein upon firing a round of ammunition, pressurized gas within the barrel enters the piston chamber to move the piston rearward and cycle the bolt assembly.

The method may further include adjusting a valve pin extending transversely through the piston chamber. The step of adjusting the valve pin may throttle a gas line extending between the gas tube and the piston chamber. The piston body may include a rearward surface dimensioned and configured to abut against the stop ring to limit rearward motion of the piston rod into the receiver. The stop ring may have a gap, the method further comprising turning the stop ring upward to align the gap with the piston body, or may be completely removed thereby preventing abutting contact between the piston body and the stop ring to allow for disassembly of the retrofit assembly.

Yet a further aspect of the present invention is directed to a firearm having a bolt assembly mounted within a receiver, a barrel extending forward from the receiver, and a front sight block mounted on the barrel. The firearm further includes a gas tube/chamber extending into the front sight block fluidly connected with the barrel, a piston cylinder having an arcuate-shaped piston chamber fluidly connected to the gas tube, a piston including an arcuate-shaped piston head extending forward from a piston body and telescopically received in the piston chamber, and including a piston rod extending rearward from the piston body and dimensioned and configured to extend into the receiver for engaging with a bolt assembly within the receiver, a stop ring dimensioned and configured for mounting on the barrel and for limiting rearward motion of the piston body, and a bushing through which the piston rod extends. Upon firing a round of ammunition, pressurized gas within the barrel enters the piston chamber to move the piston rearward, for cycling the bolt assembly.

The gas tube and piston cylinder may be monolithically formed. The piston cylinder may include an adjustable valve. The adjustable valve may include a valve pin extending transversely through the piston cylinder. The valve pin may be adjustable to throttle a gas line extending between the gas tube and the piston chamber. The piston body may include a rearward surface dimensioned and configured to abut against the stop ring to limit rearward motion of the piston rod into the receiver. The stop ring may have a gap which can be turned upward to align the gap with the piston body, or may be completely removed thereby preventing abutting contact between the piston body and the stop ring to allow for disassembly of the retrofit assembly.

The methods and apparatuses of the present invention have other features and advantages which will be apparent from or are set forth in more detail in the accompanying drawings, which are incorporated herein, and the following Detailed Description of the Invention, which together serve to explain certain principles of the present invention.

DETAILED DESCRIPTION OF THE INVENTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention (s) is/are intended to cover not only the exemplary embodiments, but also various alternatives, modifications, equivalents and other embodiments, which may be included within the spirit and scope of the invention as defined by the appended claims.

Figure 1:
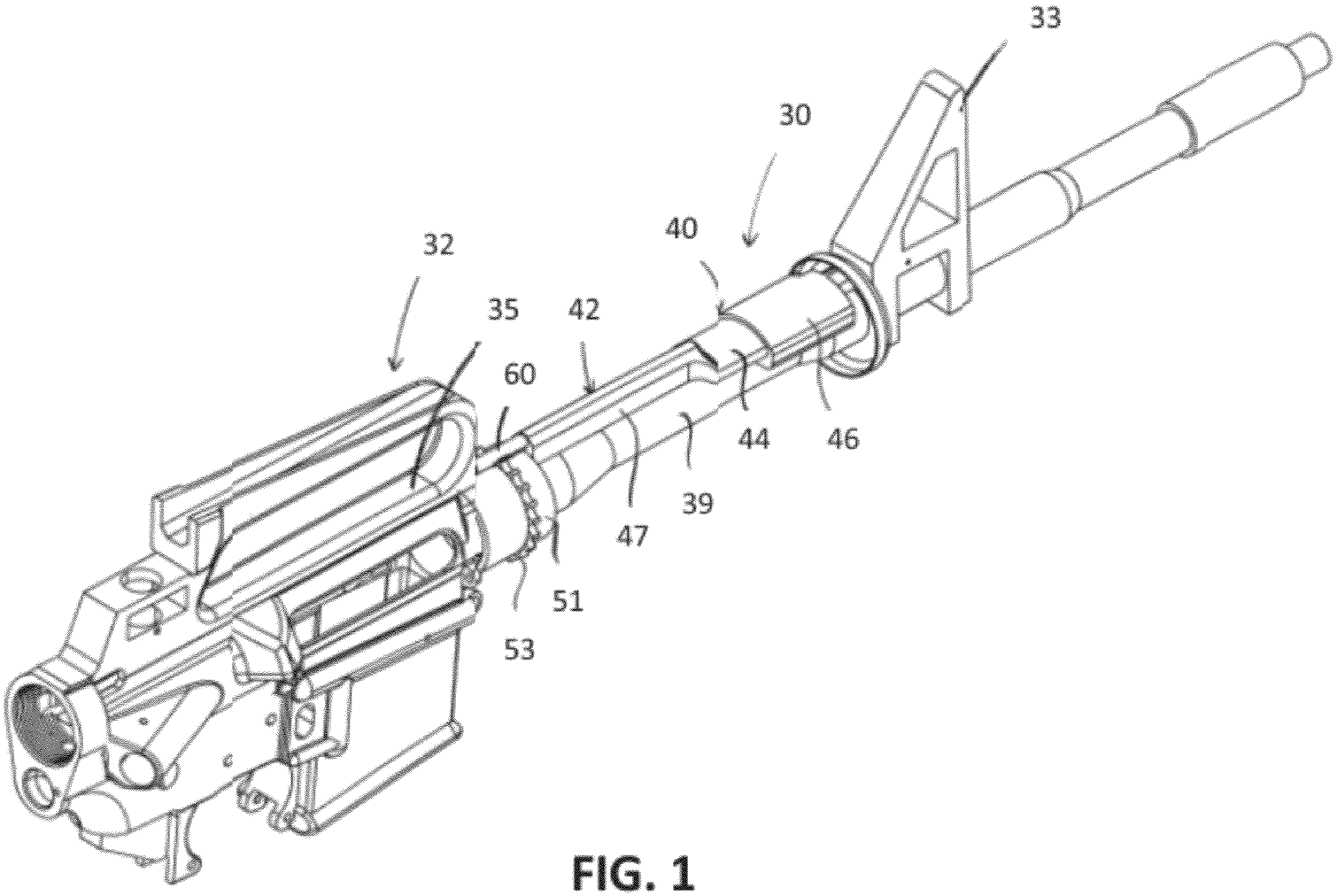
FIG. 1 is a perspective view of an exemplary gas piston retrofit assembly as mounted on a portion of an automatic firearm in accordance with various aspects of the present invention.

Turning now to the drawings, wherein like components are designated by like reference numerals throughout the various figures, attention is directed to FIG. 1 which shows a gas piston retrofit assembly, generally designated 30, mounted on an automatic firearm 32. The retrofit assembly of the present invention provides a low profile and compact design that can be fitted under conventional MIL-SPEC hand guards of the AR15/M16/M4 family of firearms. One will appreciate that the retrofit assembly of the present invention may also be dimensioned and configured for use with other automatic and/or semi-automatic firearms.

The design of the retrofit assembly of the present invention also eliminates the need to replace the upper receivers and/or other major components of such firearms. Thus, the retrofit assembly of the present invention would provide substantial savings to government and law enforcement agencies in allowing relatively low-cost modification of existing firearms as an alternative to higher-cost modification requiring replacement of upper receivers and/or other major components and the higher costs of replacement firearms. In contrast, other kits such as those provided by Patriot Ordnance Factory, Inc., Bushmaster Firearms International, LLC, Inc., Land Warfare Resources Corporation, Heckler & Koch GmbH, FN SCAR by FN Herstal, SA require the replacement of the firearm's upper receiver, bolt carrier, and/or hand guards. As such, the retrofit assembly of the present invention allows for a simple conversion by a unit soldier or armorer without the need for complex tools or to perform any gunsmithing and/or permanent alterations to existing firearms.

Advantageously, the retrofit assembly of the present invention may be designed as a retrofit assembly or kit that will readily "clip on" to an otherwise conventional AR15/M16/M4-type firearm, may be provided at a relatively low cost, and is configured to fit under the standard grips without alteration.

The above features of the present invention may account for large money savings to both military and law enforcement agencies. Furthermore and as discussed in detail below, the retrofit assembly of the present invention also provides a short-stroke gas operated system with a gas throttle/pressure regulating valve which can accommodate for use of both silencers and subsonic ammunition. Such qualities are highly desirable for all types of military and Special Forces servicemen around the globe.

Generally, the retrofit assembly converts the firearm to port gas from the barrel to a piston assembly which mechanically engages the bolt assembly instead of directing gas pressure to the bolt carrier key. In particular, the retrofit assembly replaces the conventional direct-gas-impingement tube (not shown) extending from a conventional front sight block 33 to mechanically engage a conventional bolt assembly located within a conventional upper receiver 35 backward in an otherwise conventional manner. As no gas enters the bolt chamber, the retrofit assembly establishes a more reliable firearm.

Figure 2:
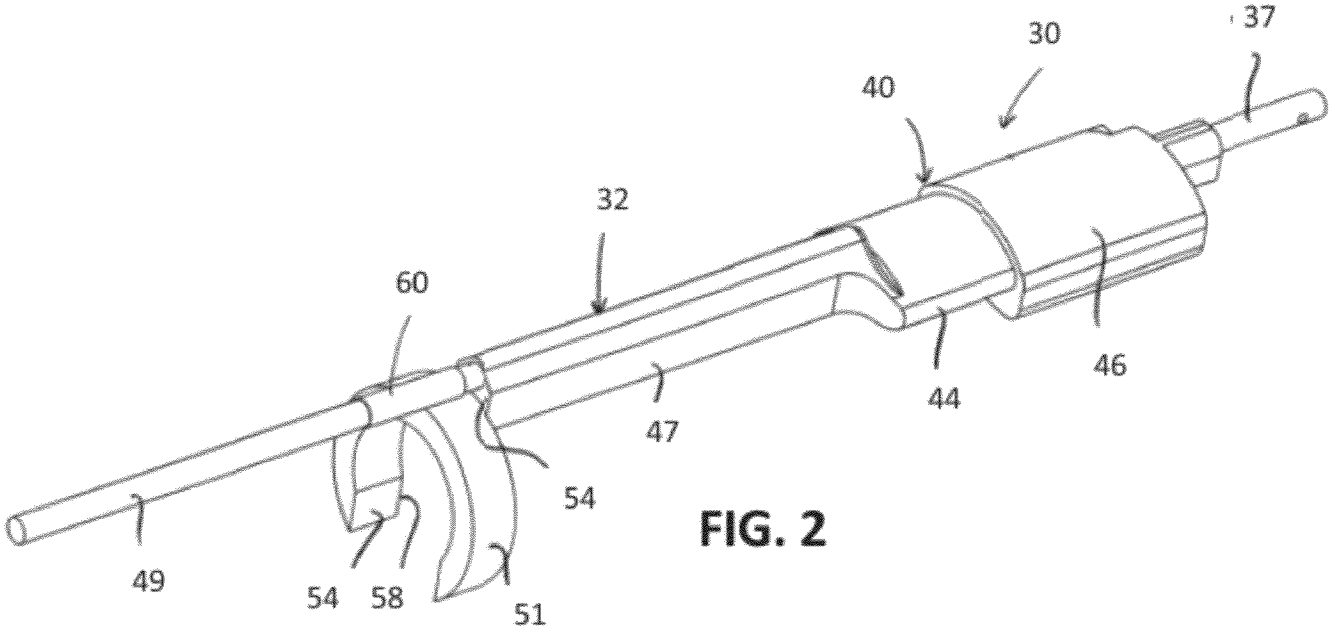
FIG. 2 is an enlarged perspective view of the retrofit assembly of FIG. 1.

Generally and with reference to FIG. 2, retrofit assembly 30 includes a tube 37 fluidly connecting gas pressure within conventional barrel 39, via a conventional gas port (not shown) within front sight block 33, with a piston assembly 40. The piston assembly includes a piston 42 (see FIG. 3) having a piston head 44 telescopically received within a cylinder 46 to convert gas pressure resulting from the firing of a round into mechanical motion. One will appreciate that cylinder 46 may be integrally and/or monolithically formed with gas tube 37. The piston also includes a piston body 47 and a piston rod or push rod 49 to direct the mechanical motion to the bolt assembly within upper receiver 35.

Figure 15:
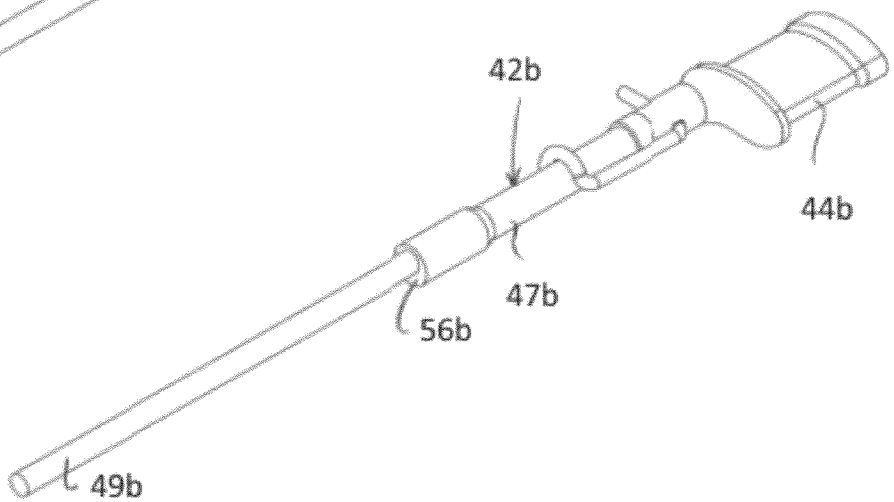
FIG. 15 is an enlarged exploded perspective view of the retrofit assembly of FIG. 13 showing the piston assembly removed from the cylinder.

One will appreciate that the various subcomponent assemblies may vary. For example, the gas tube and cylinder may be one single piece, that is, monolithically formed (see, e.g., FIG. 15). Also, the piston assembly may be configured such that it is separable (see, e.g., FIG. 16).

In addition, the retrofit assembly also includes a stop ring 51 that is dimensioned and configured to be releasably mounted on barrel 39, or push rod 49 adjacent a conventional barrel nut 53, or alternatively, on the barrel nut itself, or on the push rod. The stop ring includes a gap 54 which is positioned downward during use. The stop ring is also dimensioned and configured to limit the backward motion of piston body 47 such that a rearward surface 56 of the piston body abuts against a forward surface 58 of the stop ring. The alternatively, the stop ring may be completely removed from barrel and/or barrel nut to facilitate assembly/disassembly and general servicing.

The retrofit assembly may further include a bushing 60 to lessen or minimize wear on the stop ring and/or barrel nut by the piston rod.

Figure 13:
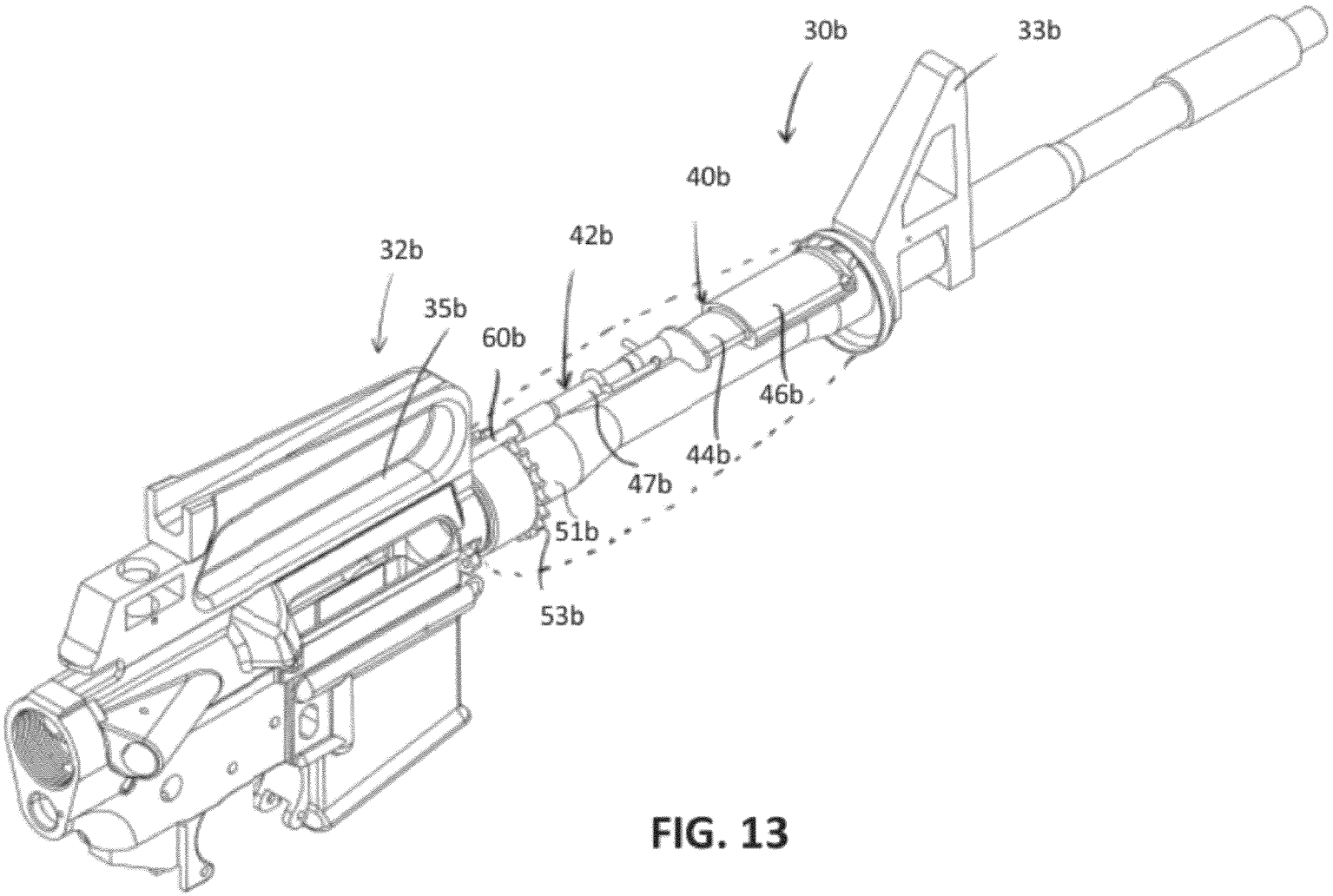
FIG. 13 is a perspective view of another exemplary gas piston retrofit assembly as mounted on a portion of an automatic firearm in accordance with various aspects of the present invention.
Figure 14:
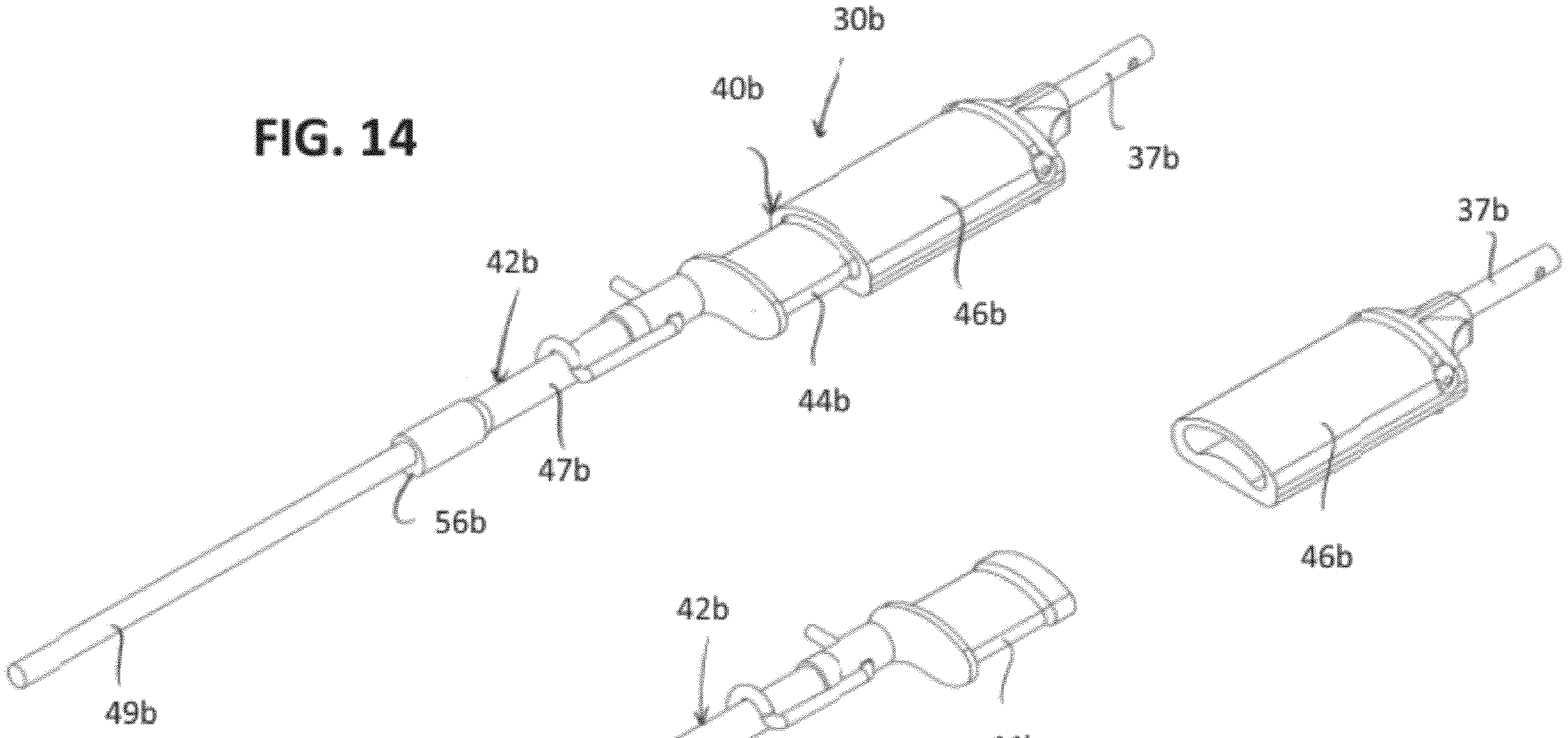
FIG. 14 is an enlarged perspective view of the retrofit assembly of FIG. 13.

One will appreciate that other suitable stops or "short stops" may be utilized. For example, in one embodiment, the piston assembly may be dimensioned and configured to abut directly against the barrel nut (see, e.g., FIG. 13).

Preferably, the tube, piston, and cylinder are formed of stainless steel. One will appreciate, however, that other materials may be utilized such as metals and alloys thereof, engineering plastics such as hardened DELRIN®, and other suitable materials.

Preferably, the tube piston and cylinder are dimensioned and configured to be releasably held in place under a conventional MIL-SPEC handgrip. In the illustrated embodiment, the retrofit assembly is free floating as the assembly does not clamp to the barrel. Instead, it floats between the front sight block and the receiver port of upper receiver 35. Alternatively, the cylinder may be clamped or otherwise fastened to the barrel by conventional means in order to be releasably mounted on the firearm.

Figure 3:
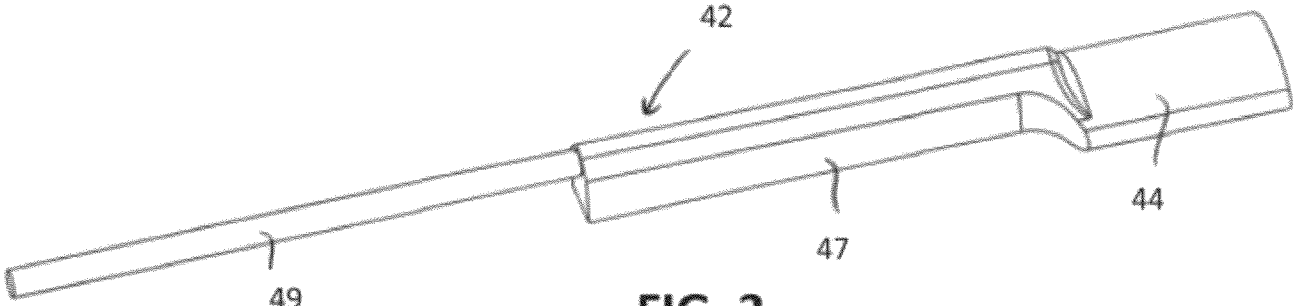
FIG. 3 is an enlarged perspective view of a piston of the retrofit assembly of FIG. 2.
Figure 4:
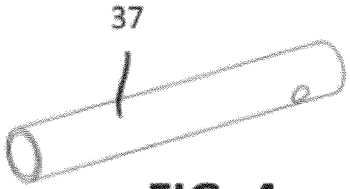
FIG. 4 is an enlarged perspective view of a tube of the retrofit assembly of FIG. 2.
Figure 5:
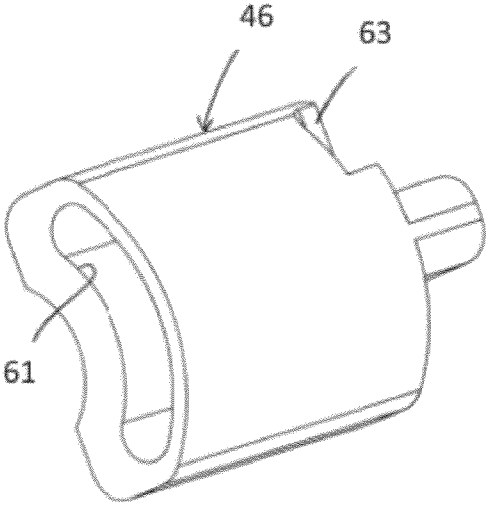
FIG. 5 is an enlarged perspective view of a cylinder of the retrofit assembly of FIG. 2.
Figure 6:
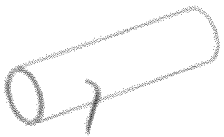
FIG. 6 is an enlarged perspective view of a bushing of the retrofit assembly of FIG. 2.
Figure 7:
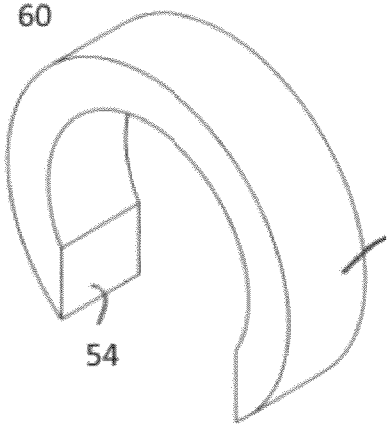
FIG. 7 is an enlarged perspective view of a stop ring of the retrofit assembly of FIG. 2.

With reference to FIG. 3 and FIG. 5, the piston assembly has been configured to maximize the cross-sectional surface area of piston head 44 while providing a low profile design that can be mounted within a conventional MIL-SPEC handgrip. In particular, piston head 44 and a chamber 61 of cylinder 46 have an arcuate, kidney-like shape. Such a shape provides the piston and chamber with a high surface area thus increasing the mechanical load that can be transmitted to the bold assembly via piston body 47 and piston rod 49. The relatively large surface area of piston head 44 and chamber 61 provides the retrofit assembly with the capability of operating properly with a broad range of ammunitions such as military and subsonic, and accessories such as silencers.

Such a shape also allows the retrofit assembly to inside the MIL-SPED front grips. One will appreciate that the configuration of the piston assembly is compatible with many handgrips and rail systems associated with the AR15/M16/M4 family of firearms. As the handgrips are not altered, neither are the firearms attachment options for both troops and law enforcement personnel.

One will appreciate that other suitable piston shapes may be utilized provided that the shape generally conforms with the shape of the barrel in order to provide a relatively high surface area and low profile.

In operation, as a round of ammunition is fired, the gas propelling the projectile will exert a pressure force within barrel 39 that will extend through the port hole of the front sight block 33, through tube 37, and into the arcuate-shaped chamber 61 of cylinder 46. Piston head 44 is subsequently propelled rearward by the gas and it moves piston body 47 and piston rod 49 rearward. This, in turn, pushes the bolt assembly rearward within upper receiver 35. Such backward motion of the bolt assembly unlocks the bolt from the chamber in an otherwise conventional manner.

Residual gas within chamber 61 is vented upward through an exhaust port 63 which opens at the top of cylinder 46. One will appreciate that the location of the exhaust port may vary. For example, the exhaust port may be located at the end or to one side of the cylinder. Or the exhaust port may be eliminated due to the use of the throttle valve.

As the bolt carrier assembly travels backward, the bolt rotates counterclockwise in a conventional manner extracting and ejecting the spent cartridge only to return forward after articulating with the baffle and recoil spring within the butt stock of firearm 32 in a known manner. On its way forward, the bolt assembly strips a fresh round from the magazine, rotates clockwise, and thus locks onto the barrel while chambering the round, also in a known manner. The hammer is recocked by the bolt assembly as it cycles back and forth, again in a known manner. Once the firearm is fired again, the whole process repeats itself.

Accordingly, a firearm equipped with a gas piston retrofit system operates in a fashion similar to that of a conventional direct gas impingement firearm (e.g., a conventional direct gas impingement AR15, M16 and/or M4). A notable exception is that no gases enter the upper receiver. As such, one advantage of the retrofit assembly of the present invention is that the receiver and the bolt assembly will run cleaner, cooler and will not fail to fire as often as conventional direct gas impingement firearms.

Advantageously, the gas piston retrofit assembly of the present invention is a non-venting system. For example, the assembly reduces the amount of heat and deposits that accumulate under the grips. Also the assembly reduces the heating of mounted accessories such scopes and lights. Moreover, non-vented systems divert less energy from the ballistic effort, and thus may improve muzzle velocity.

The gas piston retrofit assembly of the present invention also provides a high inertia piston, and trapped volume of air, which may be dimensioned and configured to reduce the shock loading to the components inside the receiver such as the gas key, bolt, and bolt carrier. Thus, the piston may be tuned to optimize system response and/or to reduce recoil. The reduced shock load may allow the use of existing gas key and bolt carrier assembly.

In addition, the retrofit assembly of the present invention provides a relatively simple design that is easily field strippable for simple cleaning on the go. For example, the rotatable and/or removable stop ring allows field servicing and cleaning with out the use of tools. For example, and with reference to FIG. 2, stop ring 51 may be rotated 180° such that gap 54 faces upward and the stop ring does not limit movement of piston 42. In particular, with the gap facing upward, piston body 47 cannot contact the stop ring, and thus is not limited to backward or leftward motion. As such, piston head 44 may be removed entirely from chamber 61, thus allowing complete disassembly without tools.

One will appreciate that a firearm can be used in various states, namely, unsuppressed or suppressed along different bullet velocities. At the two ends of the energy spectrum are unsuppressed sub-sonic rounds (low energy) and suppressed NATO rounds (high energy). Conventional direct gas impingement technologies and existing gas piston products generally have trouble handling the full spectrum of firearm ballistics. On the low energy end, a bullet may have insufficient energy to drive the bolt assembly backward and cycle the firearm. High energy ballistics, if not controlled, can cause damage to the firearm (e.g., damage a conventional the gas key).

Figure 8:
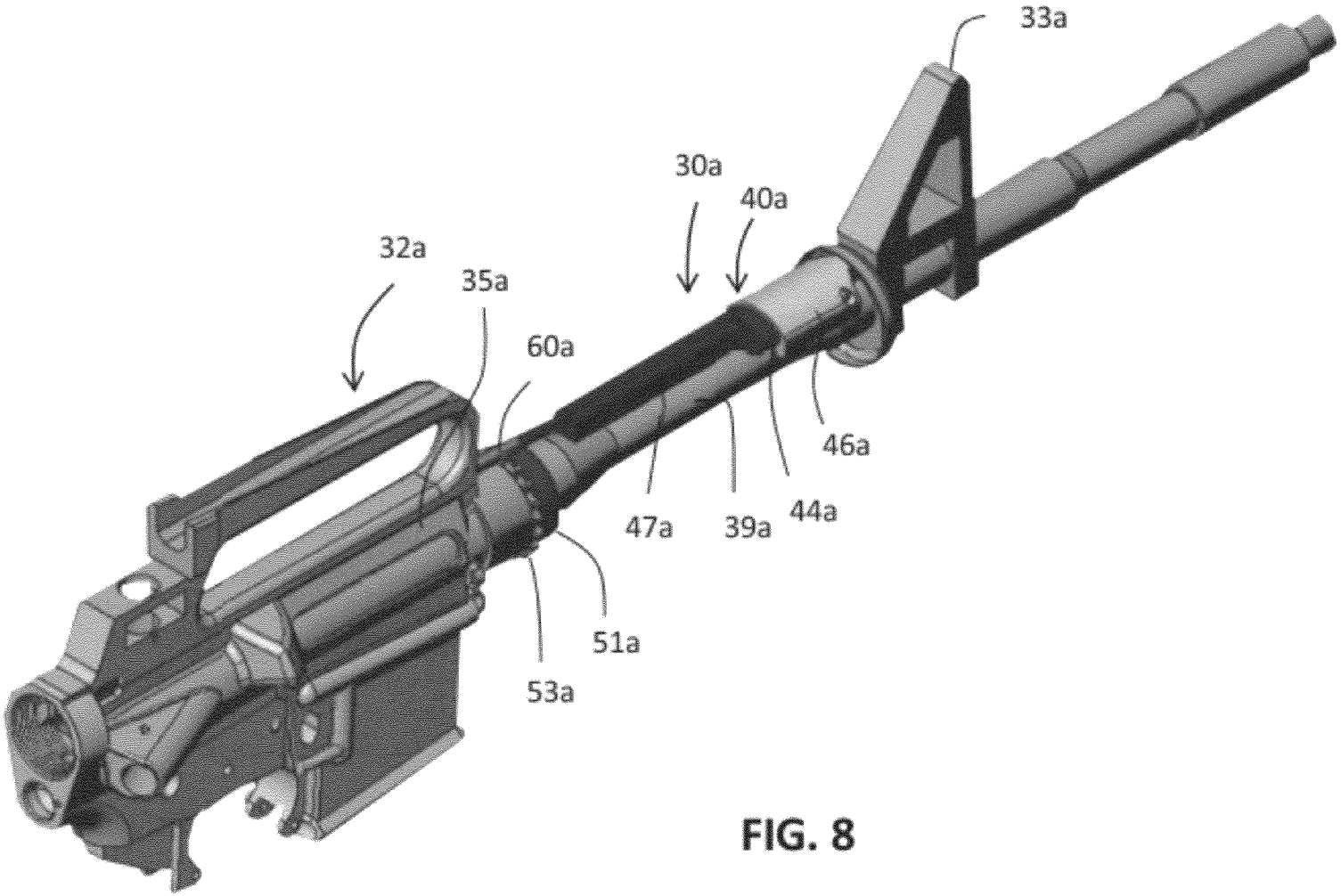
FIG. 8 is a perspective view of another exemplary gas piston retrofit assembly as mounted on a portion of an automatic firearm in accordance with various aspects of the present invention.
Figure 9:
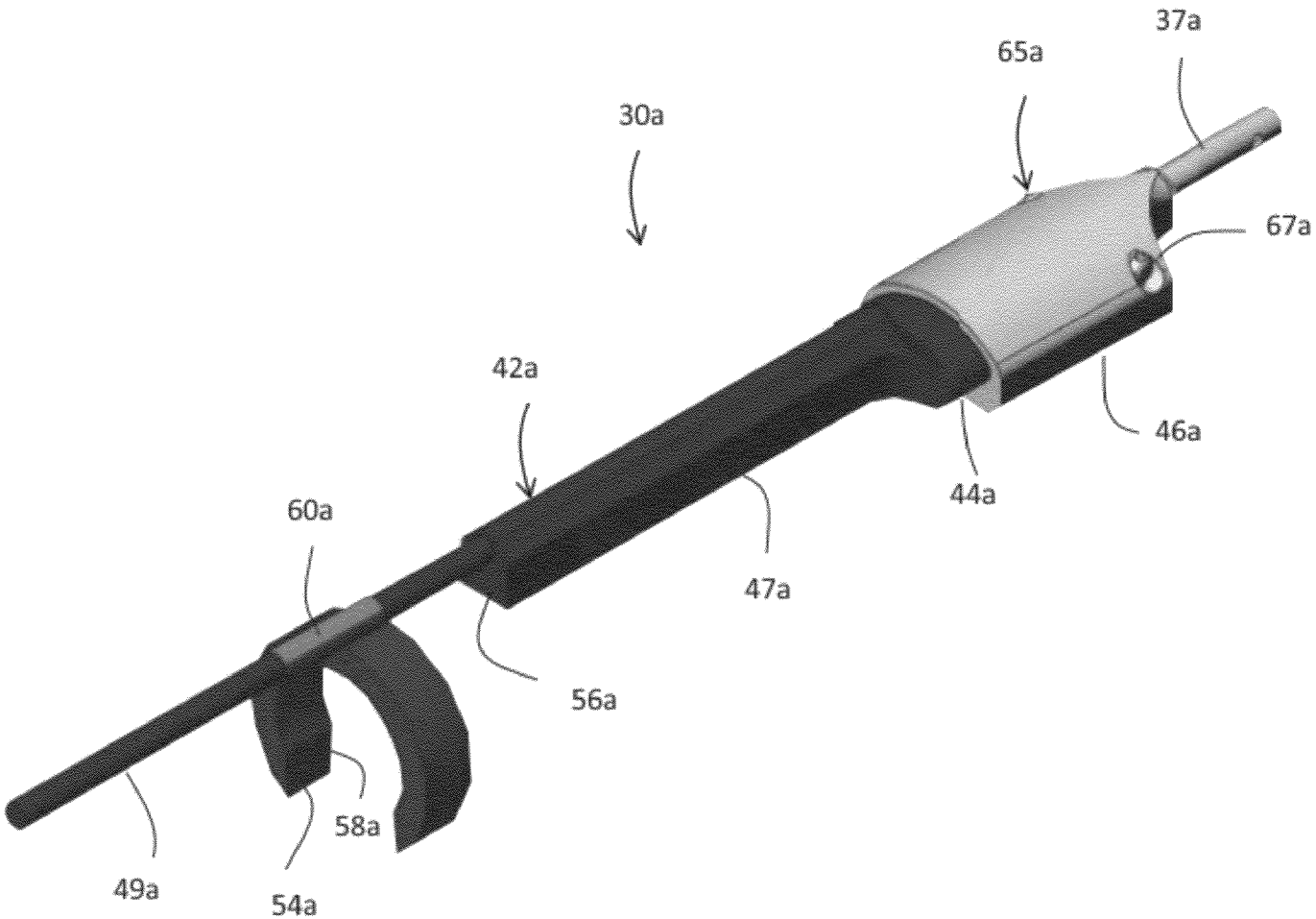
FIG. 9 is an enlarged perspective view of the retrofit assembly of FIG. 8.
Figure 10:
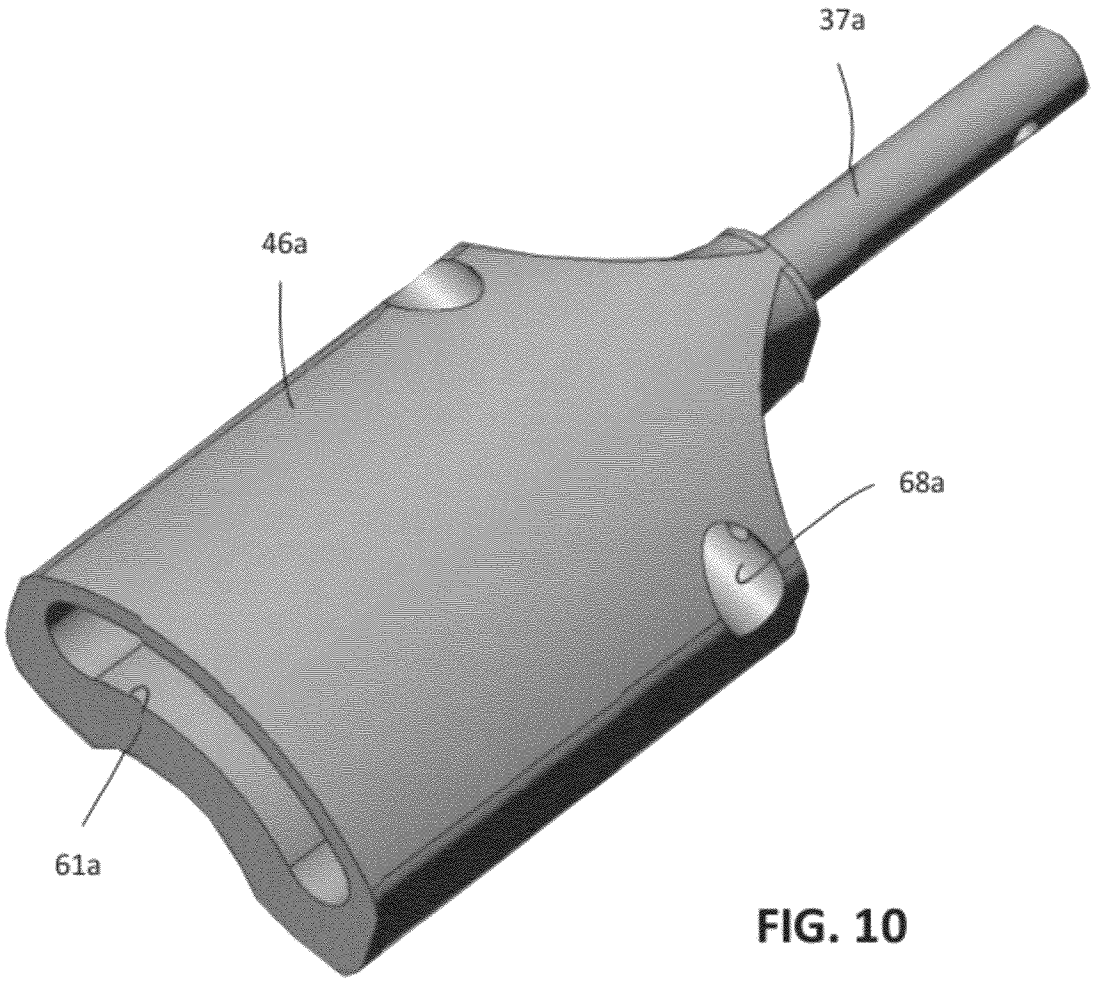
FIG. 10 is an enlarged perspective view of a valve assembly of the retrofit assembly of FIG. 8.

The retrofit assembly of the present invention may be configured to addresses these drawbacks and is equipped with an adjustable valve that can be tuned to the desired ballistic state. For example, in another exemplary embodiment of the present invention such as shown in FIG. 8, a firearm 32 may be outfitted with a retrofit assembly 30*a* provided with an adjustable valve 65 a to allow tuning of the firearm to operate correctly anywhere along the ballistic spectrum. Like reference numerals have been used to describe like components of retrofit assembly 30 and retrofit assembly 30*a*.

Figure 11:
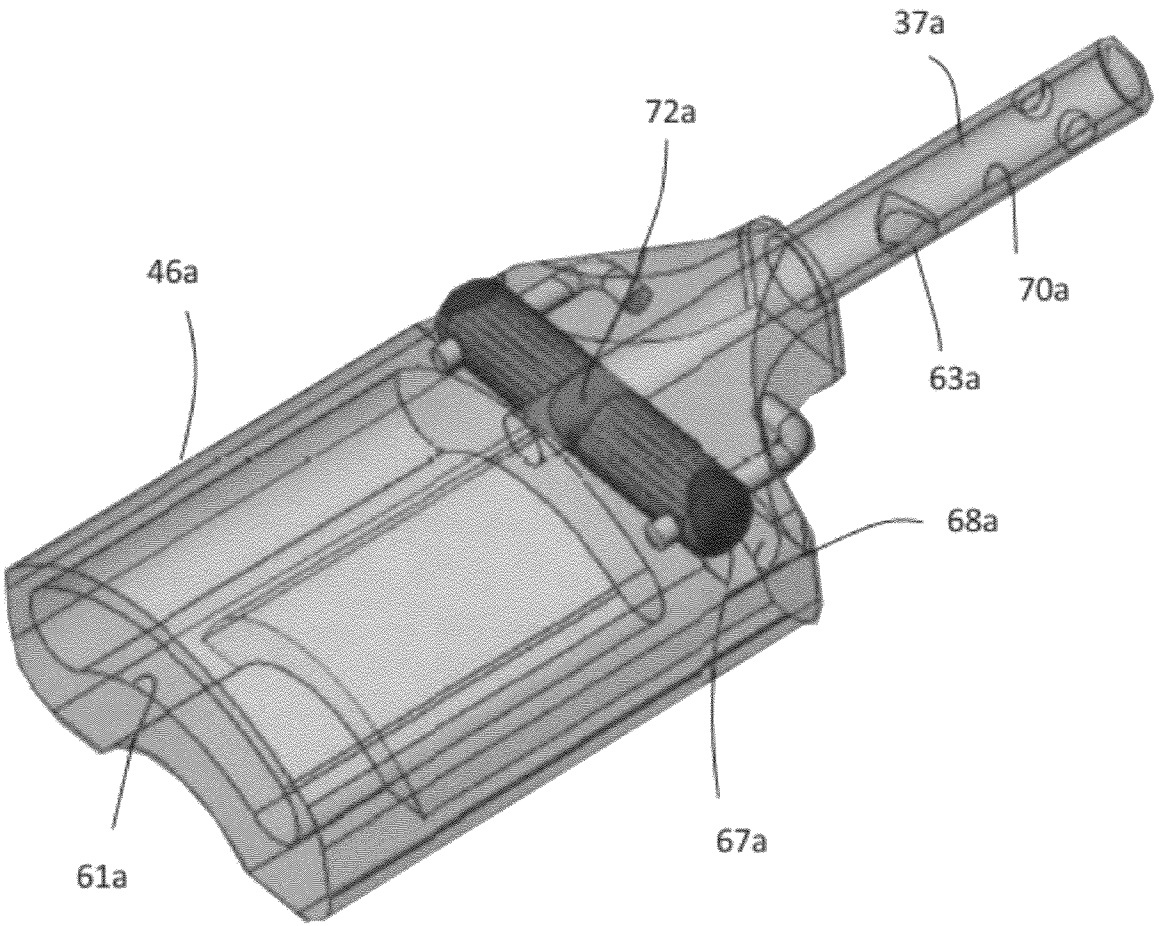
FIG. 11 is a transparent perspective view of the valve assembly of FIG. 10 illustrating its assembly with a tube and a valve pin of the retrofit assembly of FIG. 8.
Figure 12:
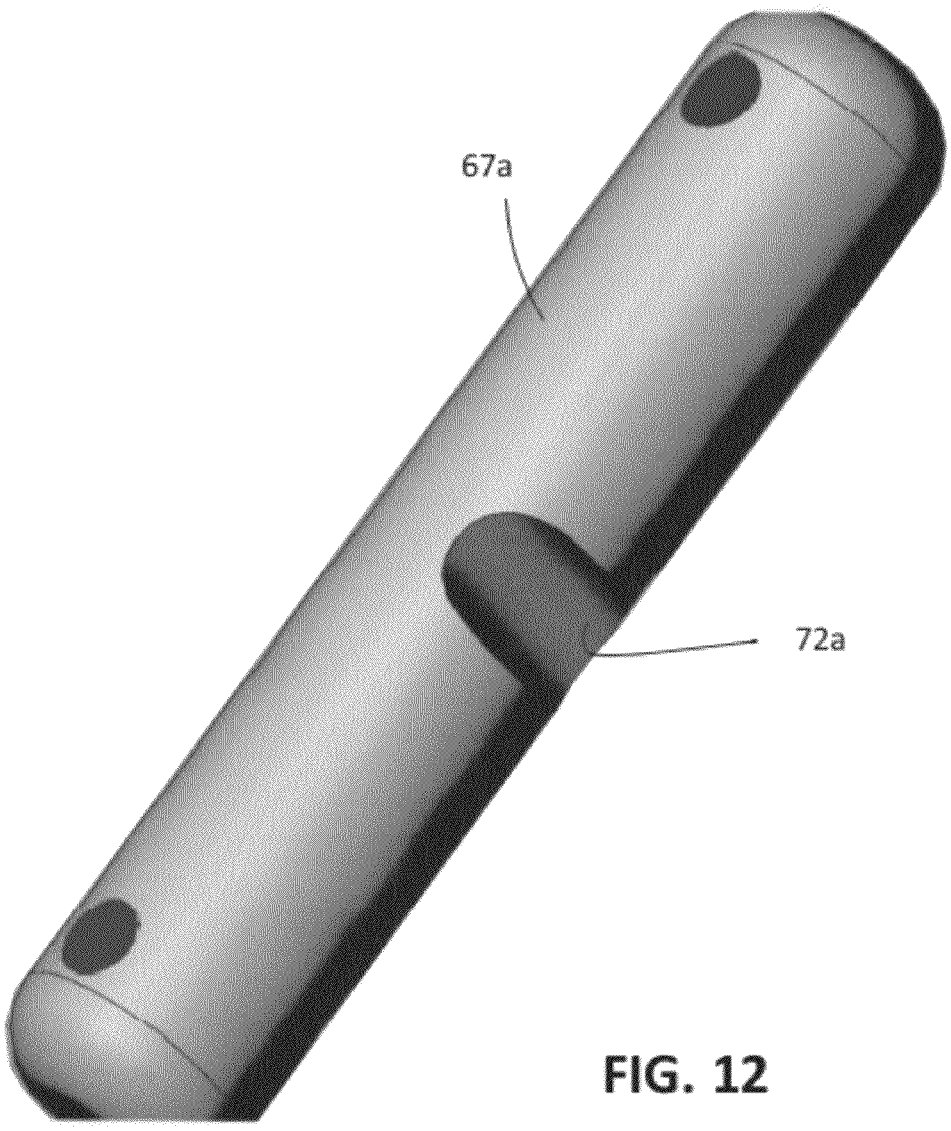
FIG. 12 is an enlarged perspective view of a valve pin of the retrofit assembly of FIG. 8.

As most clearly shown in FIG. 11, cylinder 46*a* includes a gas throttle or pressure regulator in the form of adjustable valve 65*a* located just before tube 37*a* inserts into the cylinder. The valve includes a valve pin 67*a* received within transverse bore 68*a* of the cylinder and intersects a gas line 70*a* extending through tube 37*a* and the top of cylinder 46*a*. The valve pin has a passageway 72*a* that is aligned with the gas line.

By throttling gas line 70*a* with valve pin 67*a*, the valve controls the pressure pulse coming from the barrel through the front sight block 33*a* and into barrel port. As such, the valve allows adjustment for the necessary pressure for the given application desired.

One will appreciate that valve 65*a* may be configured to throttle gas line 70*a* by rotating valve pin 67*a*, such that cutout passageway tilts and obstructs gas line 70*a* a desired amount. Alternatively, the valve may be configured such that one valve pin is removed and replaced with another having a larger or smaller cutout passageway to adjust throttling of the gas line.

In another exemplary embodiment of the present invention, retrofit assembly 30*b* is similar to retrofit assemblies 30 and 30*a* described above but includes a modified piston assembly 40*b* as shown in FIG. 13 through FIG. 17. Like reference numerals have been used to describe like components of retrofit assemblies 30, 30*a*, and 30*b*.

Figure 16:
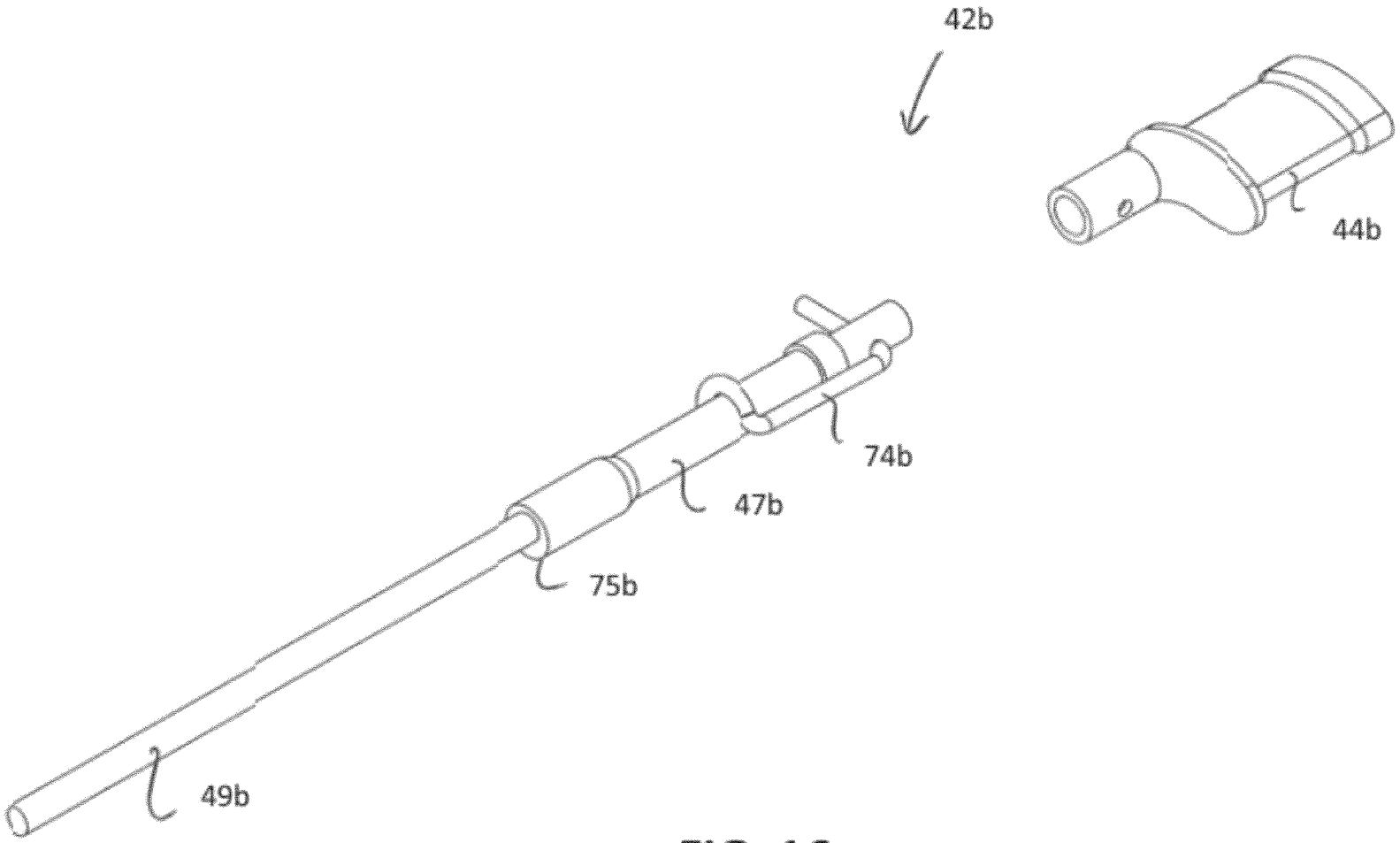
FIG. 16 is an enlarged perspective view of the piston assembly of FIG. 15 illustrating disassembly thereof.
Figure 17:
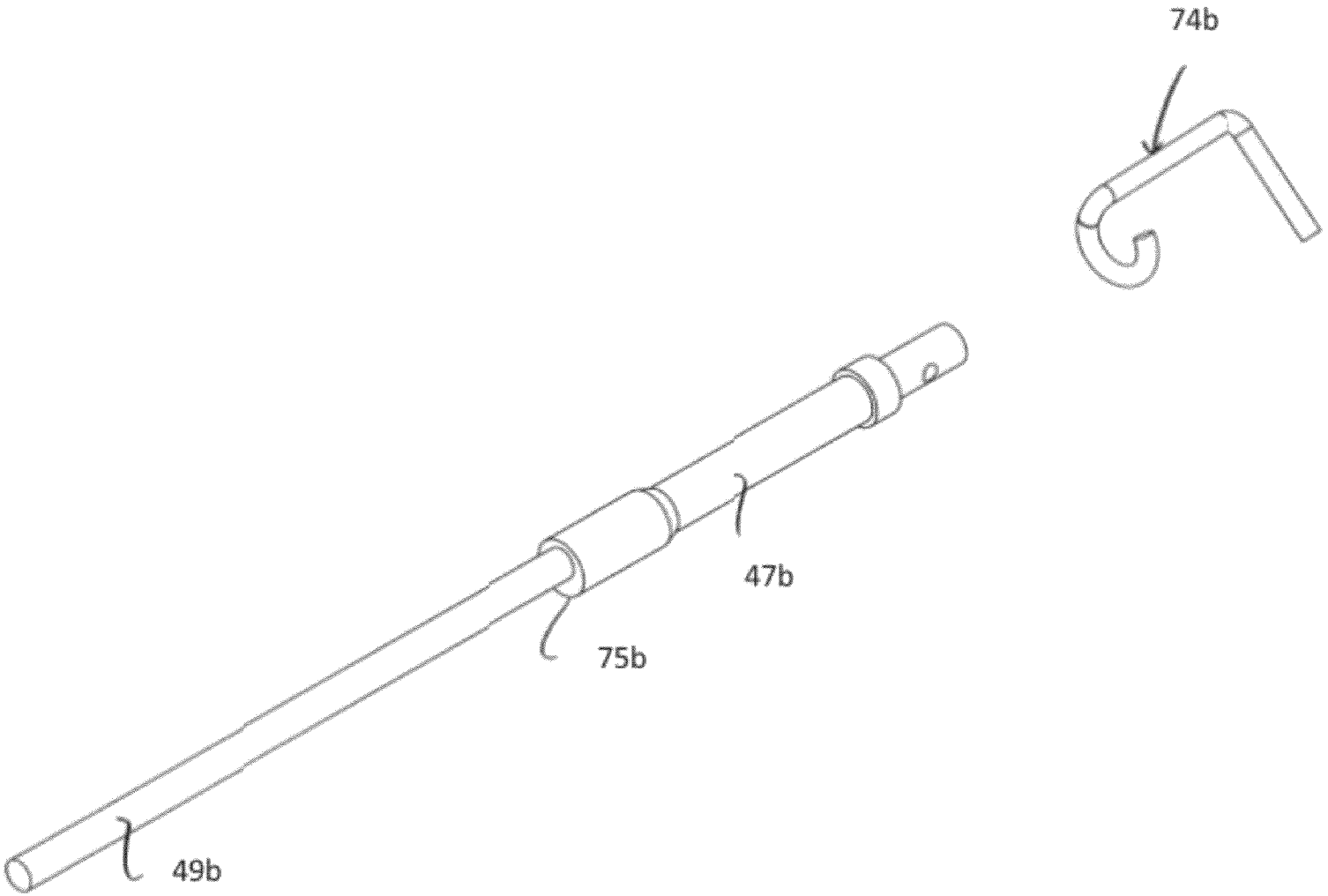
FIG. 17 is an enlarged perspective view of a pushrod of the piston assembly of FIG. 15.
Figure 18:
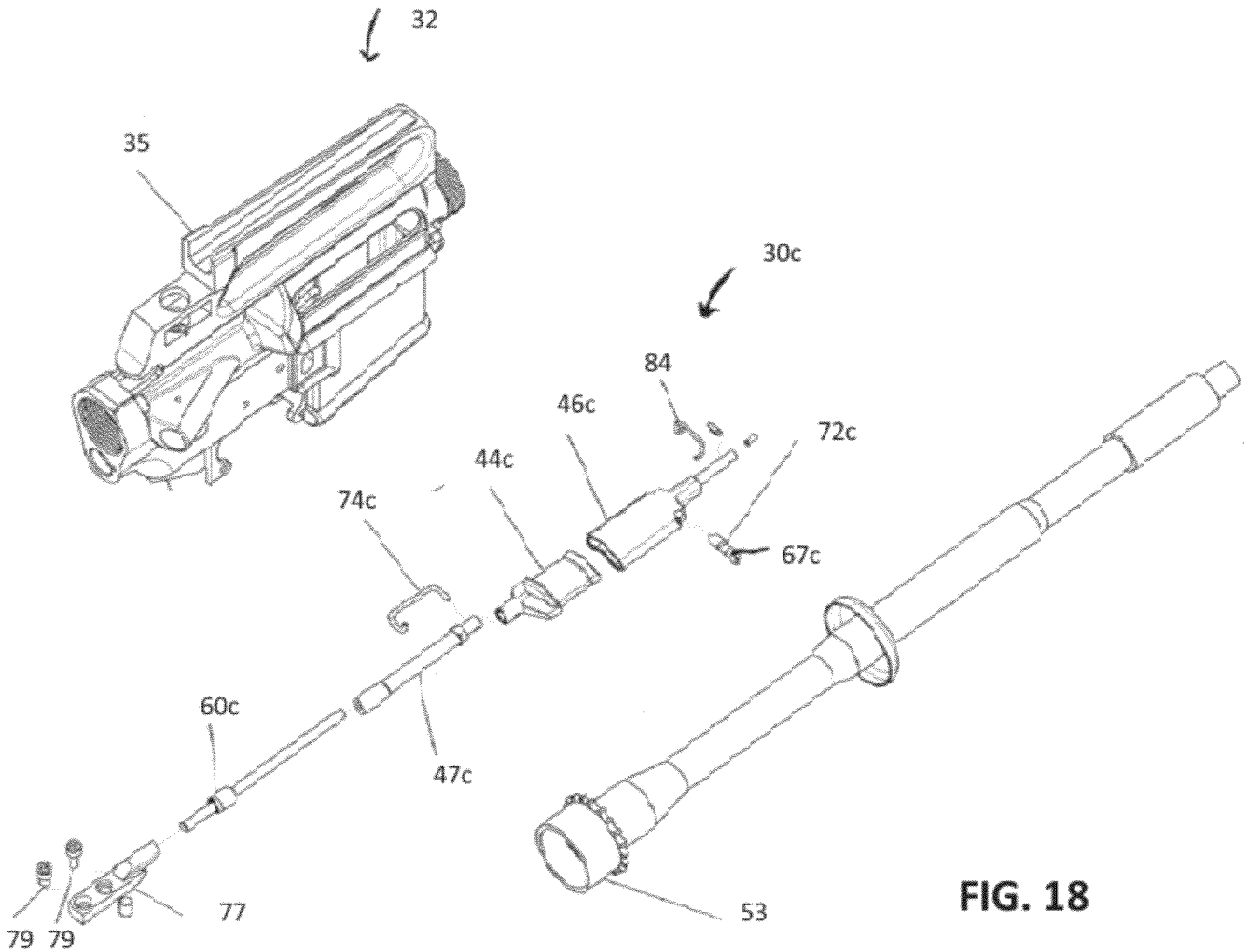
FIG. 18 is an exploded perspective view of another exemplary gas piston retrofit assembly in relation to portions of an automatic firearm in accordance with various aspects of the present invention.
Figure 22:
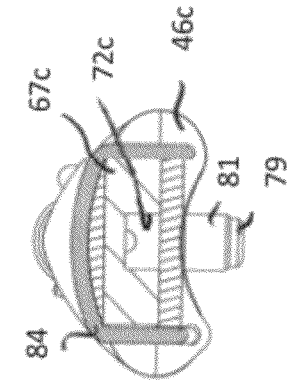
FIG. 22 is another enlarged cross-sectional view of the valve assembly similar to FIG. 21 showing the valve assembly in a throttled mode.
Figure 21:
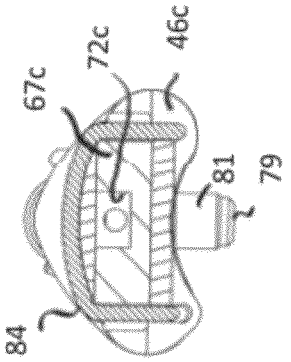
FIG. 21 is an enlarged cross-sectional view of the valve assembly of the gas piston retrofit assembly of FIG. 18 taken along line 21-21 of FIG. 20.
Figure 19:
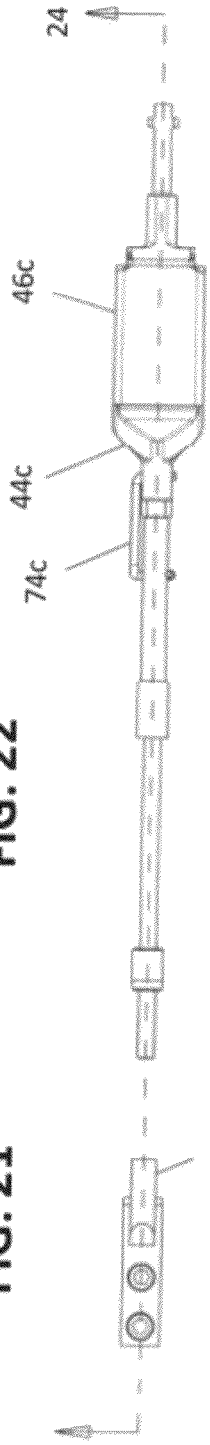
FIG. 19 is an enlarged plan view of the gas piston retrofit assembly of FIG. 18.
Figure 20:
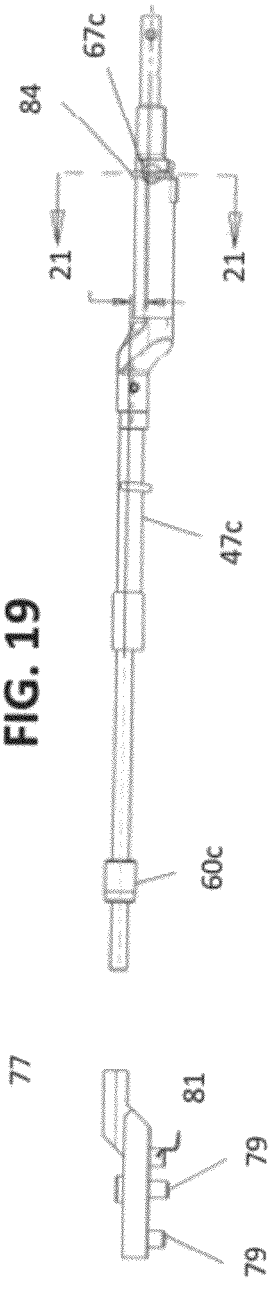
FIG. 20 is an enlarged side view of the gas piston retrofit assembly of FIG. 18.
Figure 24:
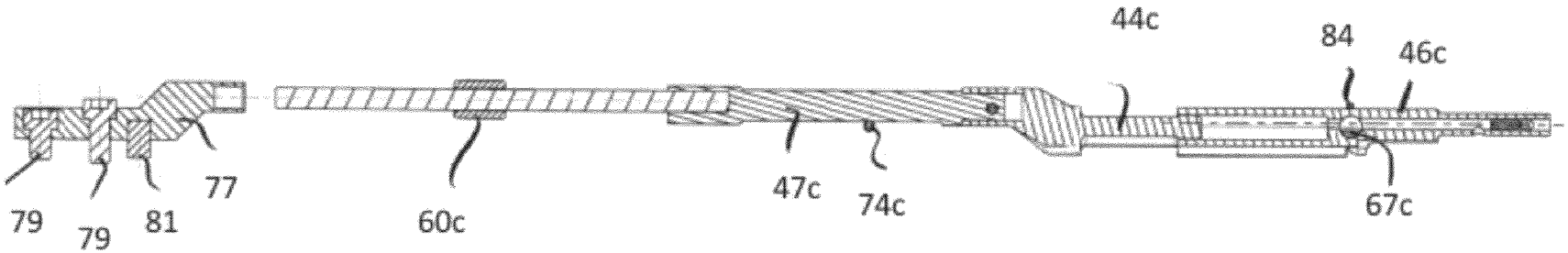
FIG. 24 is another cross-sectional side view of the gas piston retrofit assembly similar to FIG. 23 showing the piston assembly extended.
Figure 23:
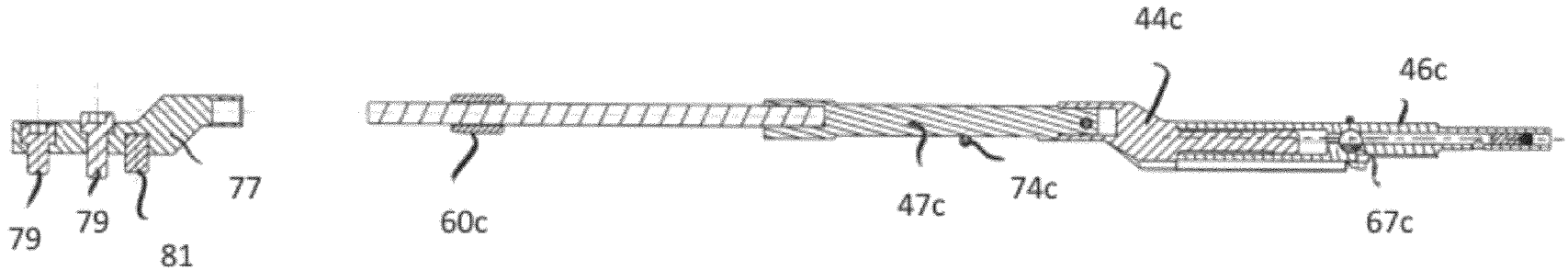
FIG. 23 is a cross-sectional side view of the gas piston retrofit assembly of FIG. 18 taken along line 23-23 of FIG. 19.
Figure 25:
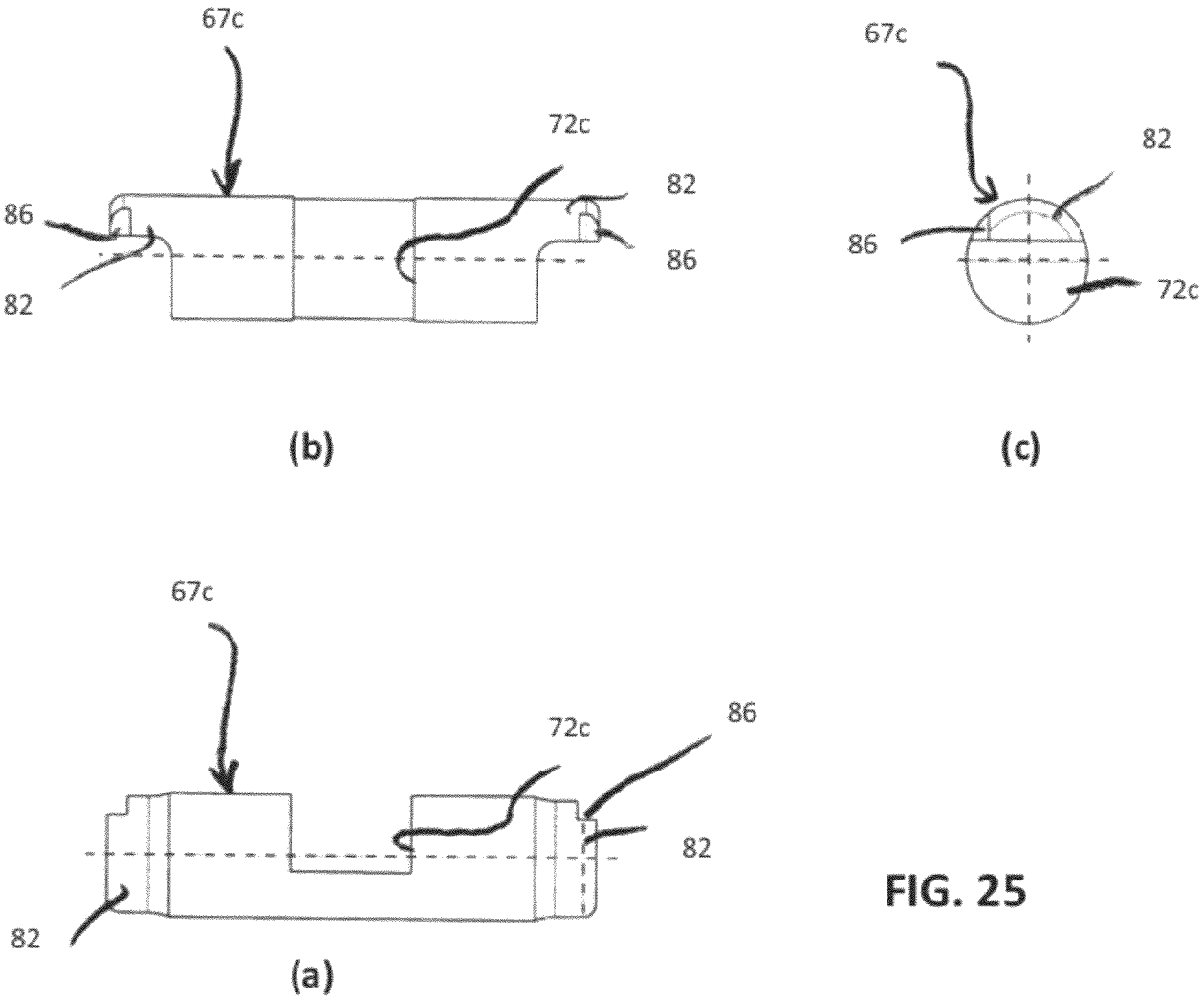
FIGS. 25(*a*), 25(*b*), and 25(*c*) are respective front, top and side views of a valve pin in accordance with the present invention.

With reference to FIG. 16, piston head 47*a* is readily separable from the remainder of piston 42*b*, that is, from piston body 47*b* and piston or push rod 49*b*. A locking pin 74*b* is dimensioned and configured to releasably secure the piston head to the piston body. In this embodiment, the piston body is also provided with an eccentric shoulder 75*b* that is dimensioned and configured to abut directly against the barrel nut to limit backward travel of the piston assembly. As such, the need for a discrete stop ring and bushing may be eliminated with the use of the eccentric shoulder. Also, in the illustrated embodiment, piston head 44*b* includes a tapered portion which accommodates form misalignment of the piston head within the chamber. One will appreciate that any one or combination of the above features may be incorporated in the earlier described embodiments.

In another exemplary embodiment of the present invention, retrofit assembly 30*c* is similar to retrofit assemblies 30, 30*a*, and 30*b* described above but includes a modified piston assembly 40*c* and a modified valve 65*c* as shown in FIG. 18 through FIG. 25(*c*). Like reference numerals have been used to describe like components of retrofit assemblies 30, 30*a*, 30*b*, and 30*c*.

In this embodiment, the piston assembly 40*c* is provided with a solid key assembly 77 which may be bolted onto a bolt assembly within upper receiver 35*c* with cap screws 79 or other fastener in an otherwise conventional fashion. A key-assembly locating pin 81 may also be provided to facilitate proper alignment during assembly. The key assembly is dimensioned and configured to receive the rearward end of push rod 49*c* in order to reduce wear and tear upon the bolt assembly.

In this embodiment, valve pin 67*c* includes asymmetric lateral shoulders 82 which extend beyond valve clip 84 when the valve pin extends through and is secured within piston cylinder 46*c*. Such asymmetric configuration allows one to discern whether the valve is in its fully opened position (see, e.g., FIG. 21) or in its throttled position (see, e.g., FIG. 22). Moreover, the valve clip includes a notch 86 that is at an upper end of each shoulder and extends upwardly as does passageway 72*c*. Thus, when notch extends upwardly, one can readily tell that the passageway extends upwardly and the valve is fully opened (see, e.g., FIG. 21). In the case where the notches extend downwardly, one can readily tell that the passageway extends downwardly and the valve has been throttled (see, e.g., FIG. 22).

For convenience in explanation and accurate definition in the appended claims, relative terms such as "up" or "upper", "down" or "lower", "inside" or "outside" and "backward" are used to describe features of the exemplary embodiments with reference to the positions of such features as displayed in the figures.

In many respects various modified features of the various figures resemble those of preceding features and the same reference numerals followed by subscripts "a", "b", and "c" designate corresponding parts.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A gas piston retrofit assembly for a firearm having a bolt assembly mounted within a receiver, a barrel extending forward from the receiver, and a front sight block mounted on the barrel, said retrofit assembly comprising:

a gas tube extending into the front sight block fluidly connected with the barrel;

a piston cylinder having an arcuate-shaped piston chamber fluidly connected to the gas tube; and a piston including an arcuate-shaped piston head extending forward from a piston body and telescopically received in the piston chamber, and including a piston rod extending rearward from the piston body and dimensioned and configured to extend into the receiver for engaging with a bolt assembly within the receiver, wherein upon firing a round of ammunition, pressurized gas within the barrel enters the piston chamber to move the piston rearward, for cycling the bolt assembly, wherein the gas tube is a hollow cylinder and a centerline of the gas tube is substantially parallel to a centerline of the piston cylinder, and wherein the piston body includes an eccentric shoulder to abut a barrel nut to limit rearward motion of the piston rod into the receiver, and wherein the piston head includes a tapered portion to accommodate alignment of the piston head with the arcuate-shaped piston chamber.

2. A gas piston retrofit assembly for firearm according to claim 1, wherein the piston cylinder includes an adjustable valve.

3. A gas piston retrofit for firearm according to claim 2, wherein the adjustable valve includes a valve pin extending transversely through the piston cylinder.

4. A gas piston retrofit for firearm according to claim 3, wherein the valve pin adjustable to throttle a gas line extending between the gas tube and the piston chamber.

5. A gas piston retrofit assembly for firearm according to claim 1, wherein the piston body includes a rearward surface dimensioned and configured to abut against the stop ring to limit rearward motion of the piston rod into the receiver.

6. A gas piston retrofit assembly for firearm according to claim 1, wherein the stop ring has a gap which can be turned upward to align the gap with the piston body thereby preventing abutting contact between the piston body and the stop ring to allow for disassembly of the retrofit assembly.

7. A gas piston retrofit assembly for firearm according to claim 1, further comprising:

a stop ring dimensioned and configured for mounting on the barrel or piston rod and for limiting rearward motion of the piston body; and a bushing through which the piston rod extends.

8. A gas piston retrofit assembly for firearm according to claim 1, wherein the piston cylinder is arcuated to maximize a cross-section surface area of the arcuate-shaped piston chamber while providing a low profile gas piston retrofit assembly, and wherein the piston cylinder is fixed on the barrel rearward from the front sight block and the piston head is secured to the piston body by a locking pin such that the gas piston retrofit assembly can be releasably mounted onto firearms.

9. A method of retrofitting a firearm having a bolt assembly mounted within a receiver, a barrel extending forward from the receiver, and a front sight block mounted on the barrel, said method comprising:

providing a gas tube and a piston cylinder having an arcuate-shaped piston chamber fluidly connected to the gas tube, wherein the gas tube is a hollow cylinder and a centerline of the gas tube is substantially parallel to a centerline of the piston cylinder;

inserting an arcuate-shaped piston head of a piston into the piston chamber, the piston including a piston body and piston rod extending rearward from the piston head, the piston rod dimensioned and configured to extend into the receiver for engaging with a bolt assembly within the receiver; and mounting a stop ring on the barrel, the stop ring being dimensioned and configured for limiting rearward motion of the piston body;

wherein the piston body includes an eccentric shoulder to abut a barrel nut to limit rearward motion of the piston rod into the receiver, and wherein the piston head includes a tapered portion to accommodate alignment of the piston head with the arcuate-shaped piston chamber; and wherein upon firing a round of ammunition, pressurized gas within the barrel enters the piston chamber to move the piston rearward and cycle the bolt assembly.

10. A method of retrofitting a firearm according to claim 9, wherein the method further comprises adjusting a valve pin extending transversely through the piston cylinder.

11. A method of retrofitting a firearm according to claim 10, wherein the step of adjusting the valve pin throttles a gas line extending between the gas tube and the piston chamber.

12. A method of retrofitting a firearm according to claim 9, wherein the piston body includes a rearward surface dimensioned and configured to abut against the stop ring to limit rearward motion of the piston rod into the receiver.

13. A method of retrofitting a firearm according to claim 9, wherein the stop ring has a gap, the method further comprising turning the stop ring upward to align the gap with the piston body thereby preventing abutting contact between the piston body and the stop ring to allow for disassembly of the retrofit assembly.

14. A firearm having a bolt assembly mounted within a receiver, a barrel extending forward from the receiver, and a front sight block mounted on the barrel, the firearm further comprising:

a gas tube extending into the front sight block fluidly connected with the barrel;

a piston cylinder having an arcuate-shaped piston chamber fluidly connected to the gas tube;

a piston including an arcuate-shaped piston head extending forward from a piston body and telescopically received in the piston chamber, and including a piston rod extending rearward from the piston body and dimensioned and configured to extend into the receiver for engaging with a bolt assembly within the receiver;

a stop ring dimensioned and configured for mounting on the barrel and for limiting rearward motion of the piston body; and a bushing through which the piston rod extends;

wherein the piston body includes an eccentric shoulder to abut a barrel nut to limit rearward motion of the piston rod. into the receiver, and wherein the piston head includes a tapered portion to accommodate alignment of the piston head with the arcuate-shaped piston chamber;

wherein the gas tube is a hollow cylinder and a centerline of the gas tube is substantially parallel to a centerline of the piston cylinder; and wherein upon firing a round of ammunition, pressurized gas within the barrel enters the piston chamber to move the piston rearward, for cycling the bolt assembly.

15. A firearm according to claim 14, wherein the piston cylinder includes an adjustable valve.

16. A firearm according to claim 15, wherein the adjustable valve includes a valve pin extending transversely through the piston cylinder.

17. A firearm according to claim 16, wherein the valve pin is adjustable to throttle a gas line extending between the gas tube and the piston chamber.

18. A firearm according to claim 14, wherein the piston body includes a rearward surface dimensioned and configured to abut against the stop ring to limit rearward motion of the piston rod into the receiver.

19. A firearm according to claim 14, wherein the stop ring has a gap which can be turned upward to align the gap with the piston body thereby preventing abutting contact between the piston body and the stop ring to allow for disassembly of the retrofit assembly.

* * * * *